US005365324A

United States Patent [19]

Gu et al.

[11] Patent Number: 5,365,324

[45] Date of Patent: Nov. 15, 1994

[54] MULTI-IMAGE FORMING APPARATUS

[75] Inventors: Sono Gu, Omiya; Yoshinori Nagao, Kawasaki, both of Japan

[73] Assignee: Canon Kabushiki Kaisha, Tokyo, Japan

[21] Appl. No.: 94,917

[22] Filed: Jul. 22, 1993

Related U.S. Application Data

[63] Continuation of Ser. No. 775,135, Oct. 11, 1991, abandoned.

[30] Foreign Application Priority Data

Oct. 12, 1990 [JP] Japan ..... 2-273816

[51] Int. Cl.[5] ..... G03G 15/01

[52] U.S. Cl. ..... 355/326 R; 346/138; 355/211; 355/273

[58] Field of Search ..... 346/134, 138, 157; 355/271, 272, 308, 326, 327, 309, 313, 273

[56] References Cited

U.S. PATENT DOCUMENTS 4,162,843 7/1979 Inoue et al. ..... 355/327
4,610,529 9/1986 Koizumi ..... 355/327
4,664,501 5/1987 Koizumi et al. ..... 355/327
4,788,574 11/1988 Matsumoto et al. ..... 355/326
4,873,541 10/1989 Hirose et al. ..... 346/157 X
4,887,101 12/1989 Hirose et al. ..... 346/157 X

*Primary Examiner*—Michael L. Gellner
*Assistant Examiner*—Patrick J. Stanzione
*Attorney, Agent, or Firm*—Fitzpatrick, Cella, Harper & Scinto

[57] ABSTRACT

A multi-image forming apparatus for forming a multi-image by sequentially transferring images formed at a plurality of image forming stations including image bearing members onto a transfer sheet and aims to prevent the damage due to the friction thereof. The apparatus is so designed that, while a transfer sheet conveying means is being engaged by the image bearing members of the plural image forming stations arranged along a transfer sheet feeding direction, the transfer sheet conveying means and the image bearing members are driven without stopping one of these elements (i.e., image bearing members or transfer sheet conveying means) alone.

7 Claims, 13 Drawing Sheets

MULTI-IMAGE FORMING APPARATUS

This application is a continuation of application Ser. No. 07/775,135 filed Oct. 11, 1991, now abandoned.

BACKGROUND OF THE INVENTION

1. Field of the Invention

The present invention relates to an image forming apparatus having a plurality of image forming stations each including an image forming means disposed around an image bearing member.

2. Related Background Art

FIG. 2 shows a laser beam printer which has four image forming stations and which can output an image in response to color decomposing signals of an original from an image reader (not shown) and to which the present invention is applicable. FIG. 2 illustrates an example of laser beam printers having a plurality of light scanning means. In this laser beam printer, there are provided four image forming stations each of which has an image forming means (conventional electrophotographic process) disposed around an image bearing member comprising an electrophotographic photosensitive member, and images formed on the image bearing members at the respective image forming stations are sequentially transferred onto a transfer sheet carried by a belt-shaped moving body moving adjacent to the image bearing members.

More specifically, photosensitive drums 1M, 1C, 1Y, 1K are disposed in image forming stations Pm, Pc, Py, Pk for magenta, cyan, yellow, black colors, respectively, and are rotated in clockwise directions, respectively. Around the photosensitive drums 1M, 1C, 1Y, 1K, there are disposed image forming means comprising corona chargers 2M, 2C, 2Y, 2K, optical scanning devices (as laser beam scanning means) 3M, 3C, 3Y, 3K, developing devices 4M, 4C, 4Y, 4K, and cleaning devices 5M, 5C, 5Y, 5K, respectively.

Further, a transfer portion 6 forming a part of the image forming means has an endless belt (transfer sheet conveying means) *6a* which is common to all of the image forming stations, and transfer corona dischargers 10M, 10C, 10Y, 10K, and a full-color image is obtained by sequentially transferring color images formed on the photosensitive drums onto a transfer sheet P supported on the transfer belt *6a*. The transfer belt *6a* is urged against the photosensitive drums by respective urging members made of elastic sheets 10MA, 10CA, 10YA, 10KA.

The transfer sheet P is supplied from a sheet cassette 7, and, after the transfer process, the sheet P is forcibly separated from the transfer belt and is fed to an ejection tray 9 through a fixing device 8.

Each of the optical scanning devices 3M, 3C, 3Y, 3K is constituted by a laser device acting as a light source, a rotary polygonal mirror for scanning the laser beam, an $f\theta$ lens for focusing the scanning beam onto the generatrix on a surface of the corresponding photosensitive drum, a reflection mirror for deflecting a bundle of light beams, and a beam detecting device for detecting a specific position of the scanning beam (all of these elements are not shown).

An operation timing in the image formation means of such image forming apparatus is shown in FIG. 3 as a timing chart.

In FIG. 3, a level "1" denotes an operative condition, and a level "0" denotes an inoperative condition. In order to eliminate the unnecessary movements in the image forming apparatus, it is considered that, when a copy start key is depressed, the photosensitive drums can be rotated sequentially in order from the first image forming station, and, when the image formation and the transferring of each image to the transfer sheet are finished, the photosensitive drums in respective stations can be sequentially stopped. On the other hand, when the copy start key is depressed, the transfer belt *6a* carrying the transfer sheet thereon continues to move until all of the transfer processes are completed.

In such movements, there arises a condition that one of the photosensitive drums and the transfer belt is stopped and the other continues to move. If such condition occurs, since the transfer belt *6a* is abutted against the photosensitive drums 1M, 1C, 1Y, 1K by means of the urging members 10MA, 10CA, 10YA, 10KA, respectively, when only one of these two elements is stopped, there arise a relative movement between these elements, with the result that the photosensitive drums and/or transfer belt are damaged, thus worsening the image quality.

SUMMARY OF THE INVENTION

An object of the present invention is to provide a multi-image forming apparatus which can eliminate the above-mentioned drawbacks, can prevent image bearing members and a transfer sheet from being damaged and can form an image with stable image quality.

In order to achieve the above objects, the present invention provides a multi-image forming apparatus for forming a multi-image by sequentially transferring images formed at a plurality of image forming stations including image bearing members onto a transfer sheet, comprising a plurality of image forming stations arranged along a transfer sheet feeding direction, a transfer means for transferring images formed at the image forming stations onto a transfer sheet, a transfer sheet conveying means movable along an endless path and adapted to convey the transfer sheet to transfer portions for the respective image forming stations, and a drive means for driving the transfer sheet conveying means so that the transfer sheet conveying means can be abutted against and separated from the image bearing members of the image forming stations. The transfer sheet conveying means and the image bearing means of the image forming stations are driven while the transfer sheet conveying means is bring contacted with the image bearing members, and the transfer sheet conveying means is separated from the image bearing members after the image formed on the image bearing members are transferred onto the transfer sheet.

In still a further aspect of this invention, there is provided image forming apparatus for forming a toner image on a recording material, comprising image forming means having an image bearing member on which the toner image is formed, said image bearing member rotating at a predetermined peripheral speed when forming the toner image on the recording material; transfer means for transferring the toner image on said image bearing member onto the recording material at a transfer position; a convey belt for conveying the recording material to the transfer position, said convey belt moveable between a position contacting said image bearing member and a position apart from said image bearing member, and moving at substantially the same speed as the peripheral speed of said image bearing member when said convey belt is in the position contacting said image bearing member; wherein the speed at which said convey belt and image bearing member are moving when they are brought into contact with each other is slower than said predetermined peripheral speed of said image bearing member for forming the toner image on the recording material.

DETAILED DESCRIPTION OF THE PREFERRED EMBODIMENTS

A preferred embodiment of the present invention which is applied to the apparatus of FIG. 2 will now be explained with reference to FIG. 1.

Figure 1:
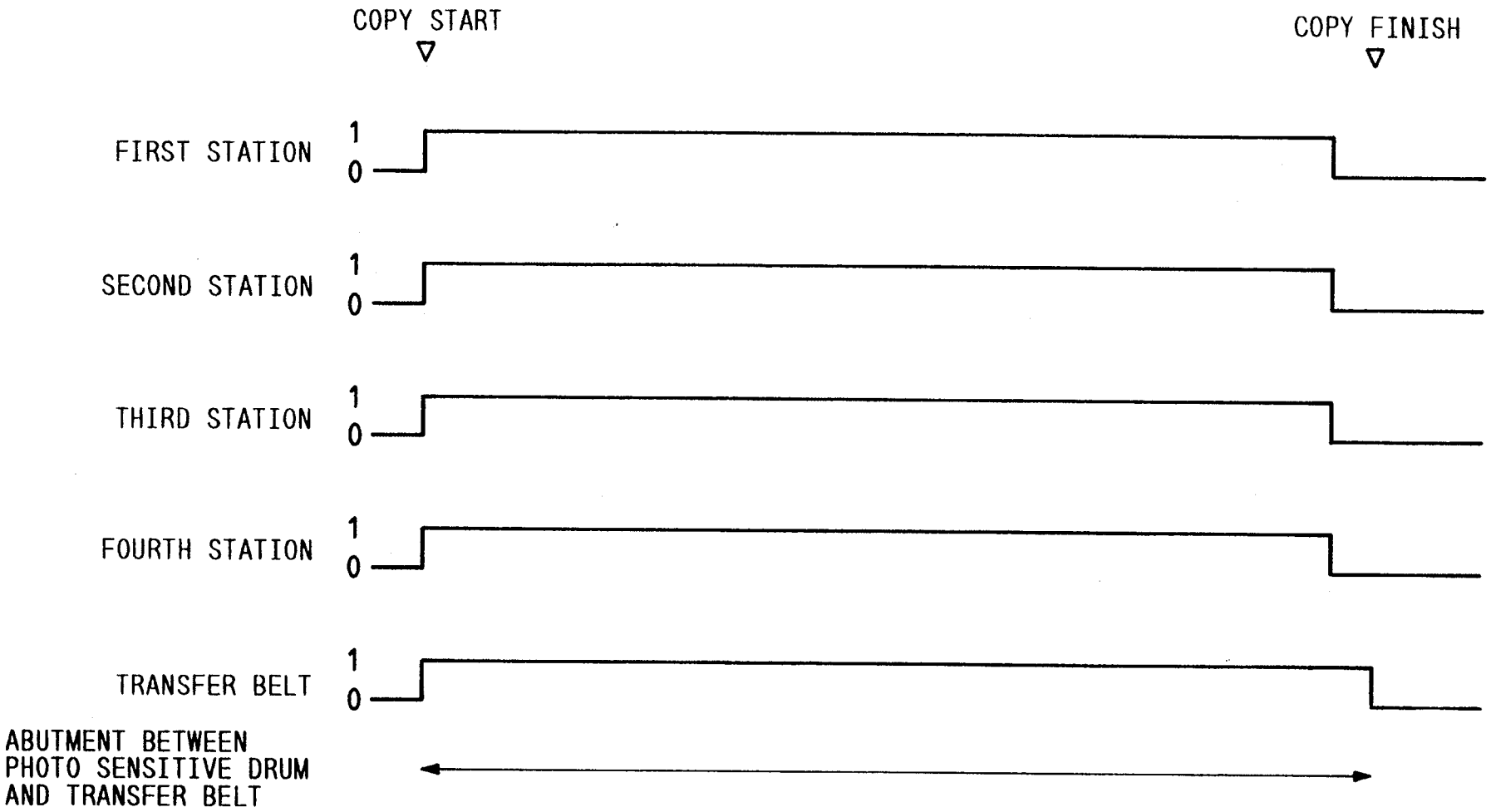
FIG. 1 is a timing chart showing an operation of a multi-image forming apparatus according to a preferred embodiment of the present invention.
Figure 2:
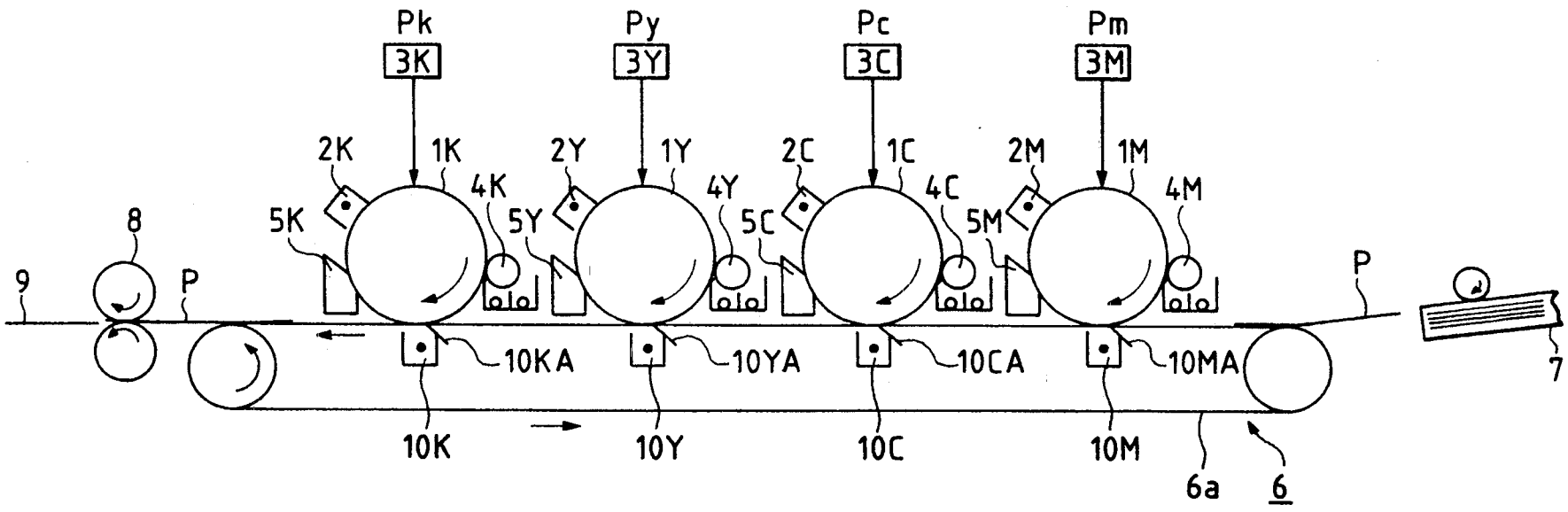
FIG. 2 is a schematic elevational view of the multi-image forming apparatus according to the present invention.
Figure 3:
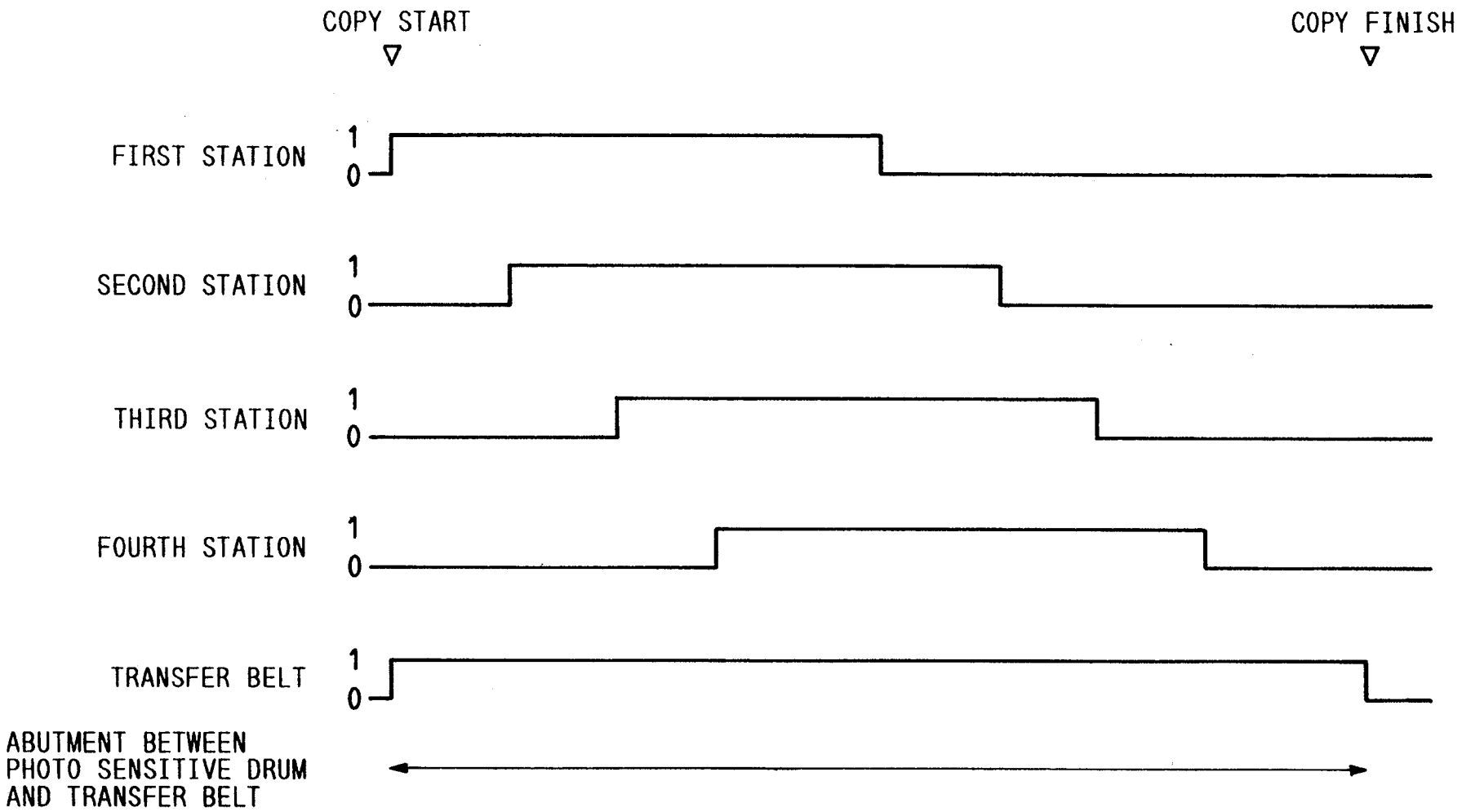
FIG. 3 is a timing chart showing an operation of a conventional multi-image forming apparatus.

FIG. 1 is a timing chart showing a copy operating condition of the apparatus of FIG. 2 to which the present invention is applied.

In FIG. 1, when the copy is started and the sheet P is supplied from the cassette 7 of the apparatus of FIG. 2, the urging members 10MA, 10CA, 10YA, 10KA are operated, thus urging the transfer belt (moving body) **6*a*** (which is being separated from the photosensitive drums) against the photosensitive drums (image bearing members). Then, the transfer belt and the photosensitive drums are simultaneously rotated to perform the image forming operation.

When the image formation and the transferring of the image at the fourth image forming station are finished, the urging members 10MA, 10CA, 10YA, 10KA are retracted, thus separating the transfer belt from the photosensitive drums. Then, the charges remaining on the photosensitive drums 1M, 1C, 1Y, 1K are removed by illuminating the uniform light from the optical scanning devices onto the drums, and thereafter, the drums are stopped. On the other hand, the transfer belt is cleaned, and is stopped after it is separated from the photosensitive drums, thus finishing the copying operation.

In the illustrated embodiment, each of the urging members 10MA, 10CA, 10YA, 10KA is constituted by a hard elastic body or rigid body made of resin sheet or metal plate formed as a part of a shield plate arranged at an upstream side of the corresponding transfer corona discharger 10M, 10C, 10Y, 10K in the transfer sheet feeding direction, and the urging members alone or together with the integral corona dischargers are shifted so that the urging members are abutted against and separated from the transfer belt. Even when the urging members alone are separated from the transfer belt, it is possible to prevent the sliding contact between the belt and the drums.

In the illustrated embodiment, while the corona dischargers 10M–10K were used as the transfer means, the transfer belt **6*a* itself may be also used as the transfer means by applying a bias voltage to the belt. In this case, the corona dischargers 10M–10K** can be omitted.

Next, another embodiment will be explained.

Figure 4:
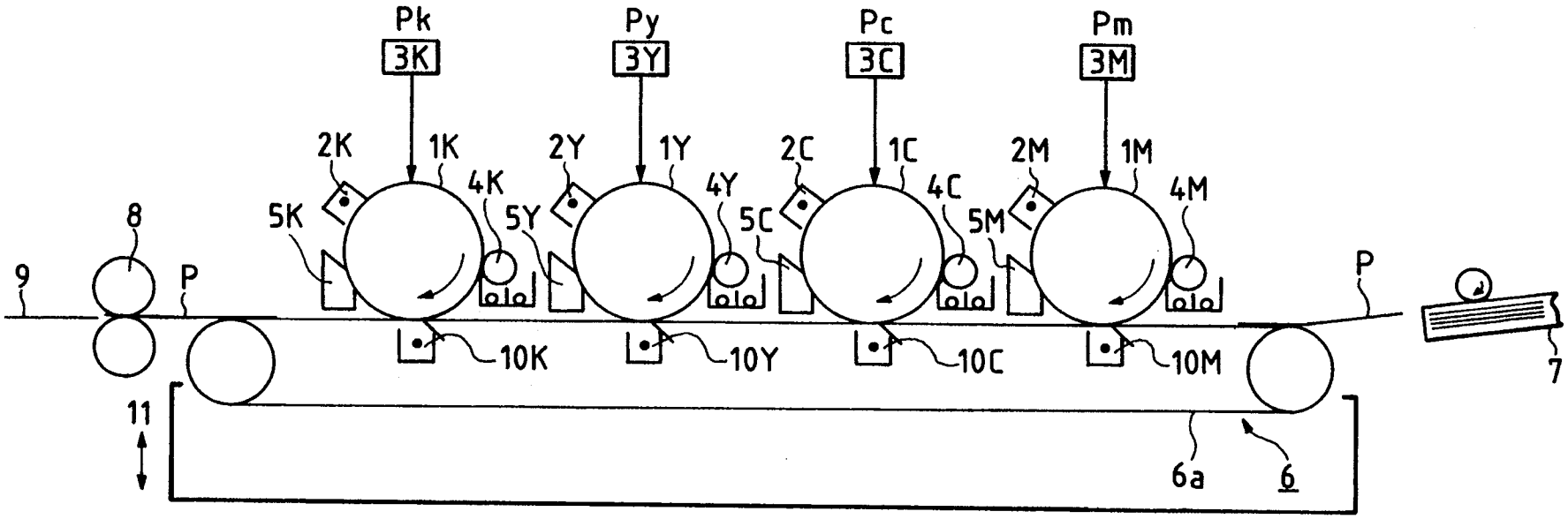
FIG. 4 is a schematic elevational view of a multi-image forming apparatus according to another embodiment of the present invention.

In the above-mentioned embodiment, while the transfer belt is abutted against the photosensitive drums through the urging members, in an embodiment shown in FIG. 4, a lifter 11 for lifting and lowering the transfer portion or transfer unit 6 including the transfer belt is provided. Same or similar structural elements are designated by the same reference numerals and the explanation thereof will be omitted.

In FIG. 4, the lifter 11 supports the transfer unit 6 and is driven by a drive means (described later) so that the belt **6*a* of the transfer unit 6 is abutted against and separated from the photosensitive drums. A copy operating condition according to this embodiment is shown as a timing chart in FIG. 5**.

First of all, when the transfer lifter operation is changed to "up" and the transfer belt is abutted against the photosensitive drums, the transfer belt and the photosensitive drums are rotated simultaneously, thus performing the image forming operation as mentioned above. After the image formation and the transferring of the images to the transfer sheet are finished, as mentioned above, the charges remaining on the photosensitive drums are removed, and then the drums and the belt are simultaneously stopped.

Thereafter, the transfer lifter operation is changed to "down" to separate the belt from the drums, thereby finishing all of the copy operations.

Regarding the timing of the engagement or disengagement between the photosensitive drums and the transfer belt, when they are driven simultaneously from a condition that they are engaged by each other, it is feared that the frictional relative movement occurs between them because of the difference in the building-up speed between them. In order to improve such problem, several examples will be described hereinbelow.

Figure 6:
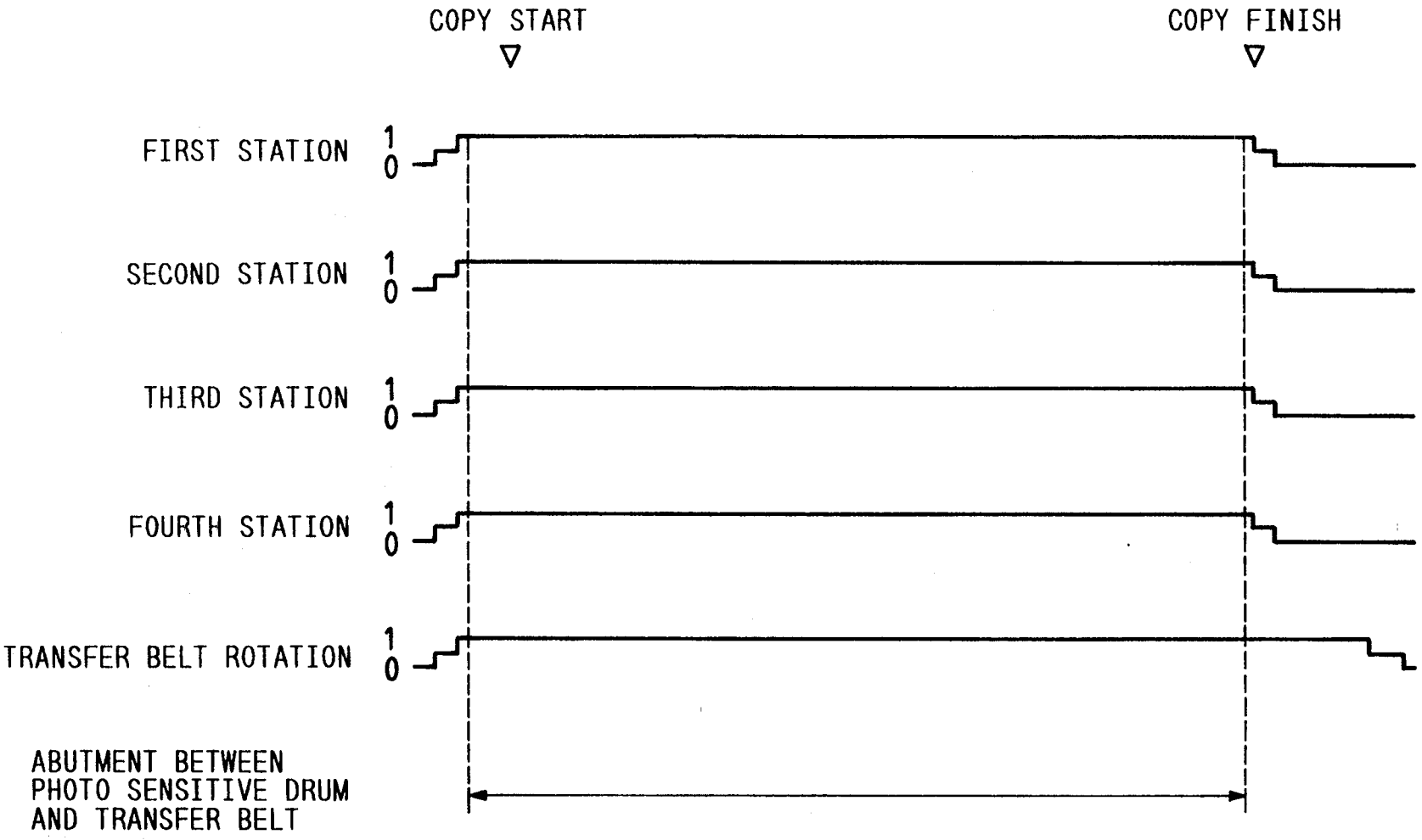
FIG. 6 is a timing chart showing an operation of a multi-image forming apparatus according to a further embodiment of the present invention.

First of all, a first example will be explained with reference to FIG. 6.

When the copying operation is started, the photosensitive drums and the transfer belt are driven from a condition that they are separated from each other. In this case, the speeds of drums and of the belt may be increased to a predetermined speed v (mm/sec) after they are once increased to a certain speed between the stopped condition (zero speed) and the predetermined speed v, or may be increased continuously from the zero speed (stopped condition) to the speed v, or may increased abruptly from the zero speed to the speed v. After the speeds of the photosensitive drum become the same as that of the transfer belt (speed v), the transfer belt is abutted against the photosensitive drums to perform the image formation.

In order to abut the transfer belt against the photosensitive drums, the above-mentioned urging members may be used, or the above-mentioned lifter for lifting and lowering the transfer unit may be used. Further, when the photosensitive drums and the transfer belt are stopped after the copying operation, they may be gradually decreased after they are separated from each other while they are moving.

Figure 7:
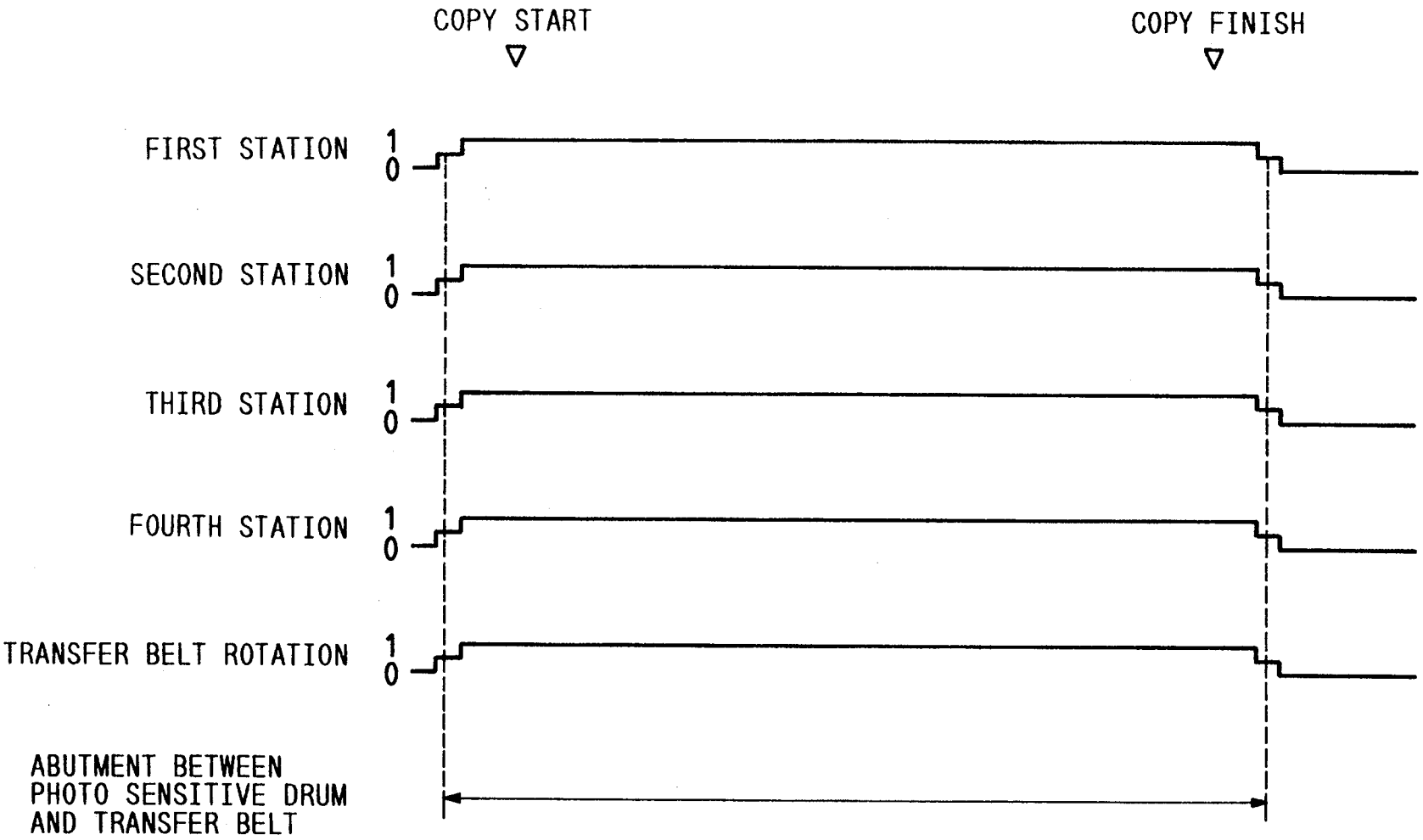
FIG. 7 is a timing chart showing an operation of a multi-image forming apparatus according to a still further embodiment of the present invention.

Another example is shown in FIG. 7. In this example, the transfer belt can be abutted against or separated from the photosensitive drums on the way that these elements are increased from the stopped condition as described with respect to FIG. 6 to the predetermined speed v. However, also in this case, the photosensitive drums and the transfer belt are driven at the same speed in the abutment period between the drums and the belt.

A further embodiment wherein a transfer means comprises a plurality of transfer units comprising transfer belts driven independently and associated with corresponding image forming stations, in place of the common transfer belt moving adjacent to the image forming stations as in the previous embodiments, will now be explained with reference to FIGS. 8 and 9.

Figure 8:
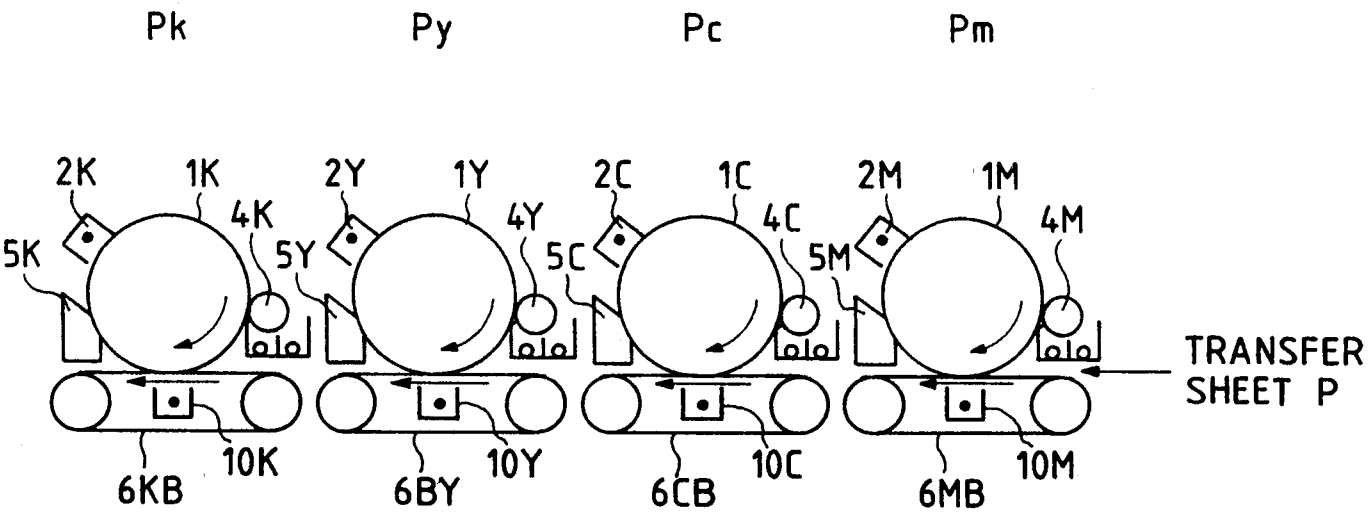
FIG. 8 is a schematic elevational view of a multi-image forming apparatus according to the other embodiment of the present invention.
Figure 9:
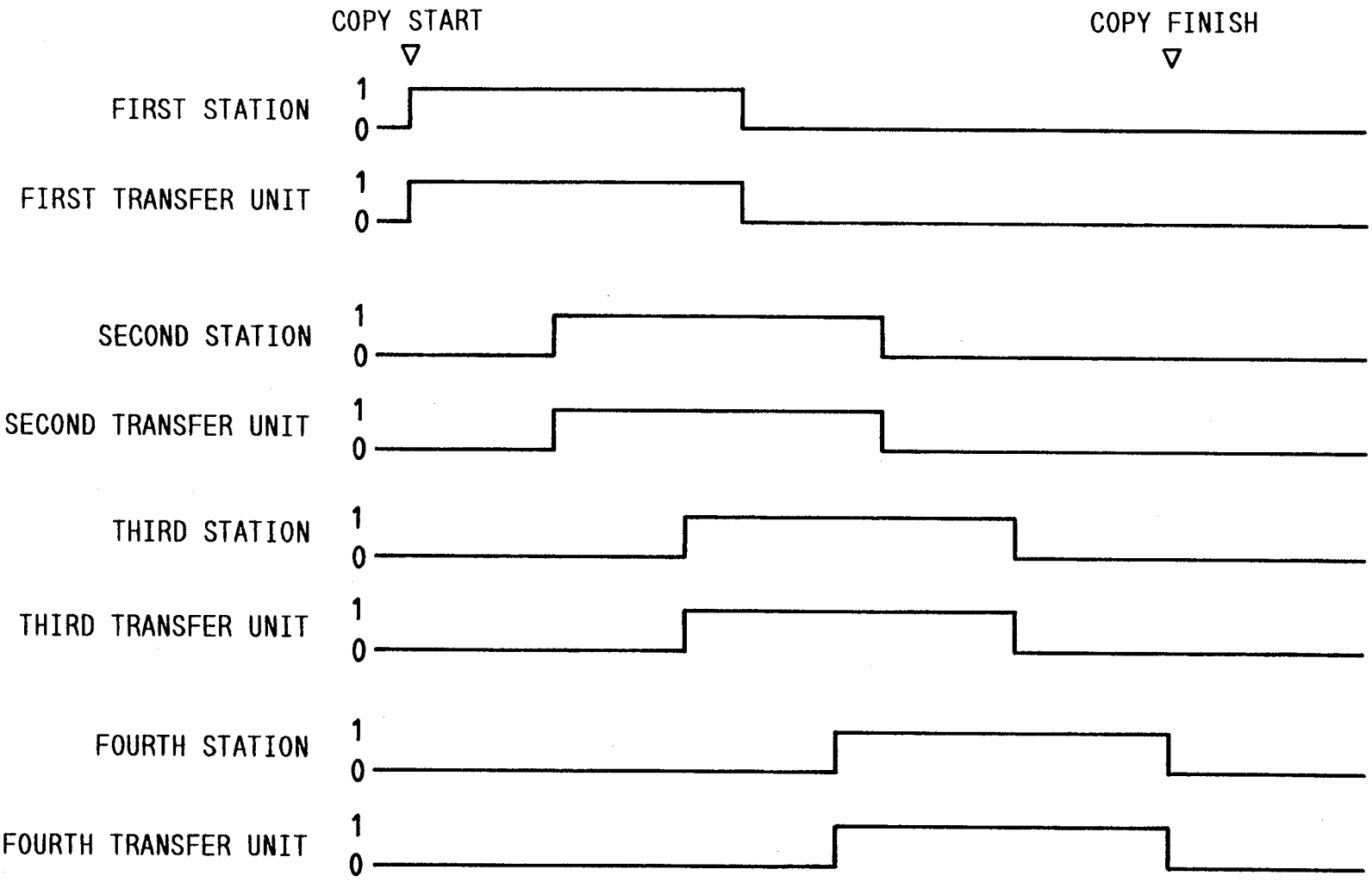
FIG. 9 is a timing chart showing an operation of the multi-image forming apparatus of FIG. 8.

In FIG. 8, the transfer means comprises transfer units 6MB, 6CB, 6YB, 6KB associated with the corresponding image forming stations. The other constructions in this embodiment are the same as those shown in FIG. 2. Now, as an example, an operation for obtaining a single copy will be described.

First of all, the first image forming station and the first transfer unit are driven to form the first (magenta) image on the first photosensitive drum and to transfer that image on the transfer sheet. When the leading end of the transfer sheet P reaches the second image forming station, the second station and the second transfer unit are rotated. On the other hand, when the transferring of the image onto the sheet at the first station is finished, after the charge remaining on the first drum is removed, the photosensitive drum of the first image forming station and the transfer belt of the first transfer unit are stopped. Similarly, the second, third and fourth stations are sequentially driven together with the associated second, third and fourth transfer unit, respectively, and then are sequentially stopped. Also in this case, in order to bring the transfer belts into contact with the corresponding photosensitive drums, the above-mentioned urging members may be used, or the above-mentioned lifters for lifting and lowering the transfer units may be used.

Next, regarding the transfer sheet conveying means used with the multi-image forming apparatuses shown in FIGS. 4 and 8, concrete examples of means for achieving the engagement and disengagement between the transfer belt(s) and the photosensitive drums will be explained with reference to FIGS. 10 to 13.

Figure 10:
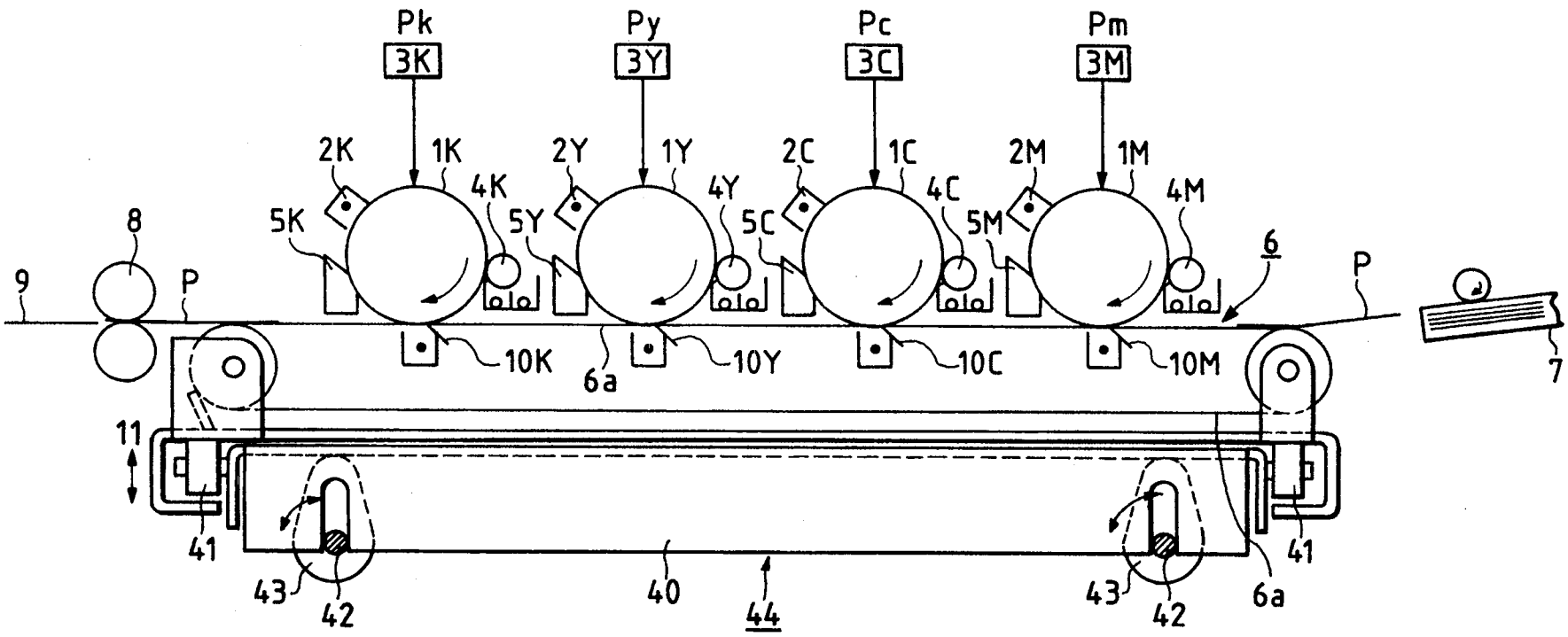
FIGS. 10 and 11 are elevational views showing a concrete drive mechanism for a transfer sheet conveying means of the apparatus of FIG. 4.
Figure 11:
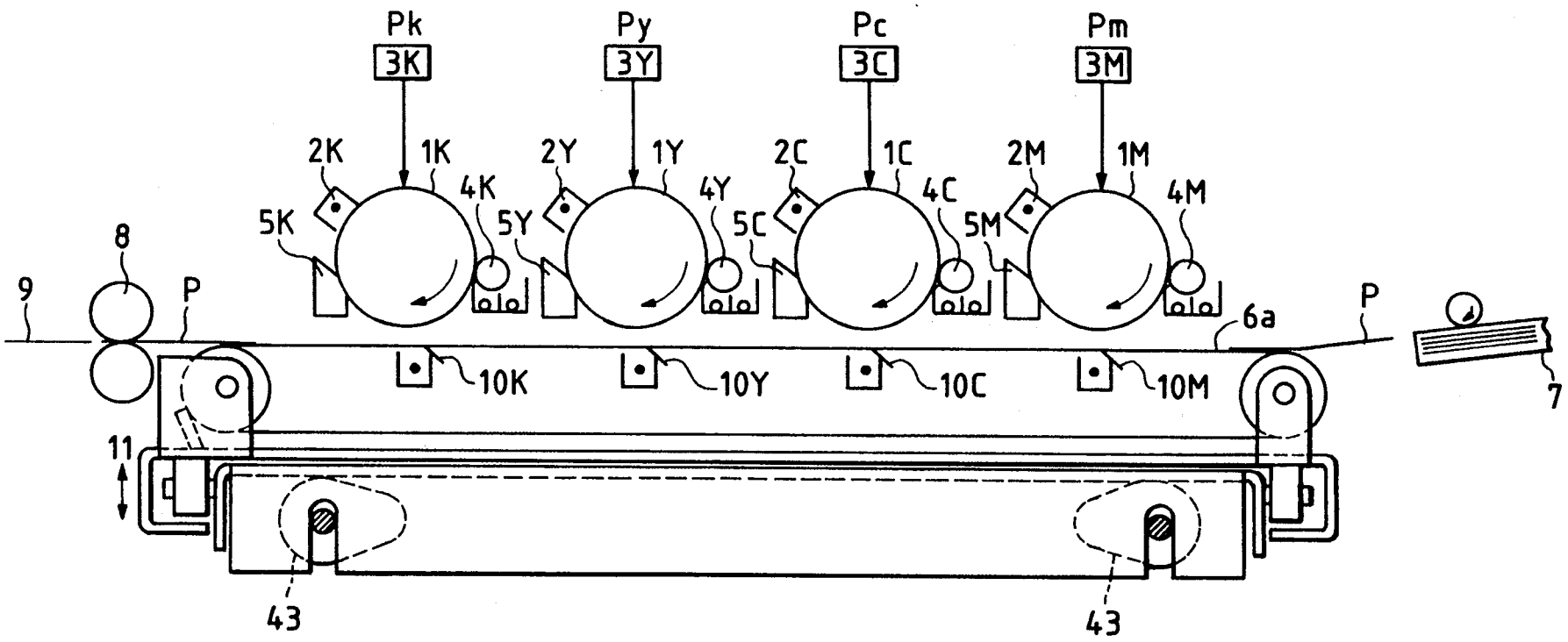

With respect to the multi-image forming apparatus shown in FIG. 4, as shown in FIGS. 10 and 11, the engagement and disengagement between the transfer belt and the photosensitive drums can be performed by lifting and lowering a lifter frame 40 supporting the transfer belt 6a. More particularly, the transfer unit 6 is supported by rollers 41 rotatably mounted on the lifter frame 40 and can be retracted in a direction perpendicular to the plane of FIG. 10 and toward the viewer of FIG. 10. The lifter frame 30 is supported by cams 43 secured to a cam shaft 42 and can be lifted (FIG. 10) and lowered (FIG. 11) by rotating the cam shaft 42 to change the lifts of the cam. The cam shaft 42 is connected to a position sensor (not shown) so that the position of the lifter frame 40 can be detected on the basis of an output signal from the position sensor. Further, the cam shaft 42 is connected to a drive source via a clutch mechanism controlled by a microcomputer (all of which not shown) in the image forming apparatus.

A lifting/lowering means 44 for changing the height of the transfer unit 6 is constituted by the lifter frame 40, rollers 41, cam shaft 42, cams 43 and the like. The lifting/lowering means 44 and the transfer unit 6 are so positioned that, when the transfer unit 6 is held at the highest position by the lifting/lowering means 44, the transfer belt 6a is abutted against the photosensitive drums 1M, 1C, 1Y, 1K.

Figure 12:
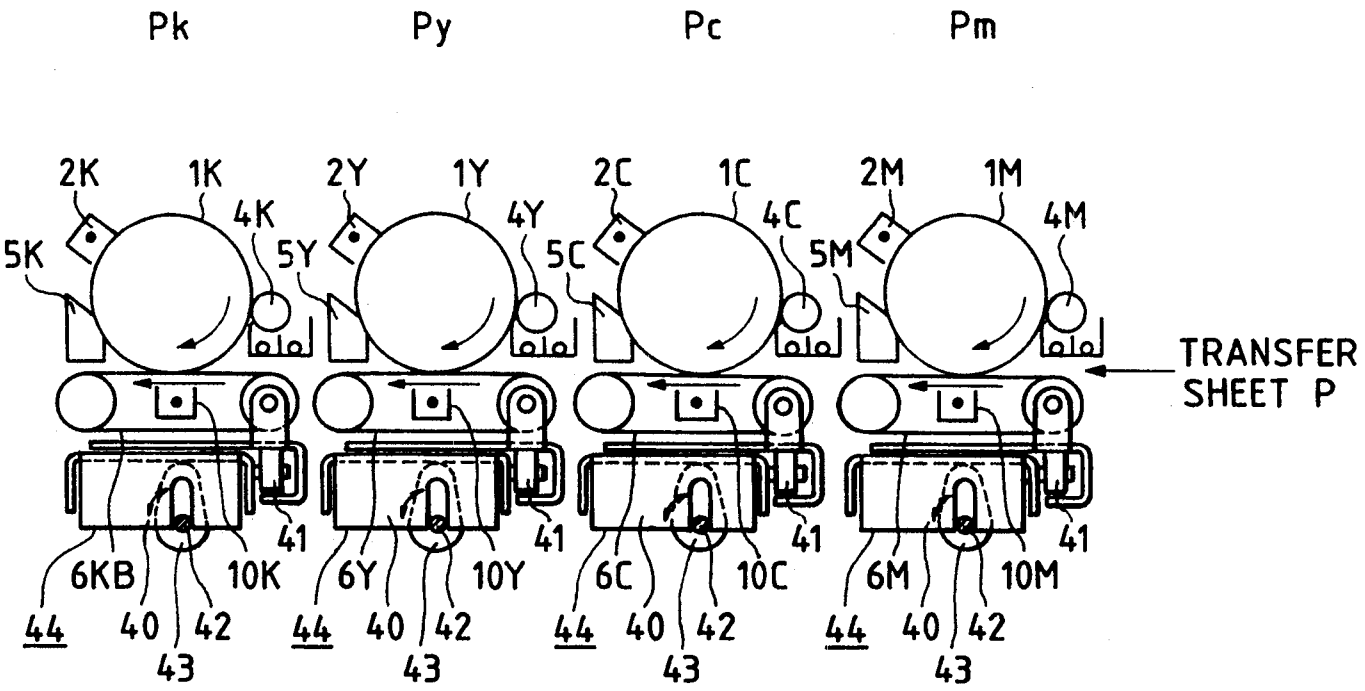
FIGS. 12 and 13 are elevational views showing a concrete drive mechanism for a transfer sheet conveying means of the apparatus of FIG. 8.
Figure 13:
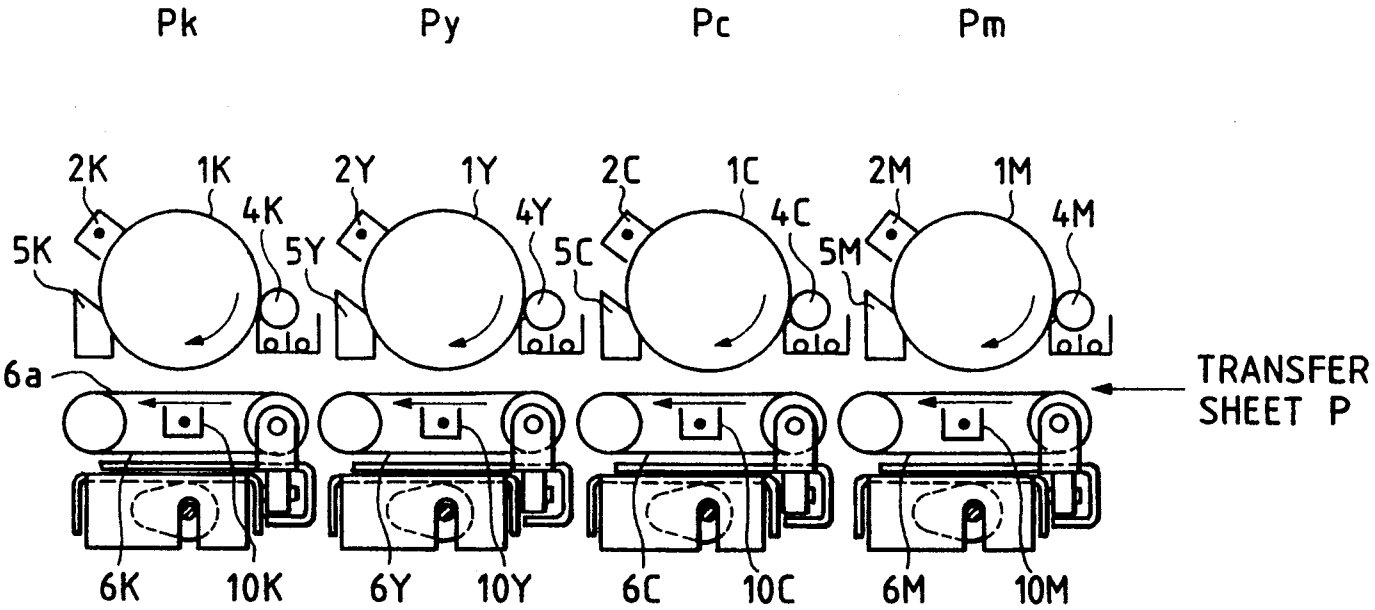

Next, with respect to the apparatus shown in FIG. 8, as shown in FIGS. 12 and 13, a lifting/lowering means 44 similar to that shown in FIG. 10 is provided for each of the image forming stations (four in total). By rotating the cams 43 of each lifting/lowering means 44, the corresponding transfer belt can be abutted against or separated from the corresponding photosensitive drum.

As mentioned above, according to the present invention, in the image forming apparatus having a plurality of image forming stations, it is possible to prevent engagement between the image bearing members such sa photosensitive drums and the transfer unit(s) or other moving member(s) such as intermediate transfer belt(s), while only one of them is being moved, thus preventing them from being damaged and the image from being distorted.

In this way, by driving the image bearing members and the transfer sheet conveying means while contacting them with each other during the image forming operation and by separating them from each other before and after the image forming operation, the following advantages can be obtained. That is to say, since the image bearing members are brought into contact with the transfer sheet conveying means without causing the frictional relative movement therebetween (i.e., since they do not contact with each other while one of them is being stopped or while they are being moved at difference speeds), they are not damaged. Further, since they are separated from each other during the non-image forming operation, the removal of the charge on the image bearing member and/or the cleaning of the image bearing members can be effected independently of the transfer sheet conveying means, before or after the image forming operation. Similarly, also regarding the transfer sheet conveying means, the removal of the charge thereon and/or the cleaning thereof can be effected independently of the image bearing members. Of course, even when such charge removal and cleaning are effected at different speeds with respect to the image bearing members and the transfer sheet conveying means, because the image bearing members are separated from the transfer sheet conveying means, they are not damaged.

What is claimed is:

1. An image forming apparatus comprising:

an image bearing member for bearing an image to be transferred to a recording material at a transfer position, said image bearing member moving at a first peripheral speed during the image transfer;

convey means for conveying the recording material to the transfer position, said convey means being moveable between a first position in contact with said image bearing member and conveying the recording material, and a second position apart from said image bearing member, said convey means moving at the first peripheral speed while in the first position during the image transfer, wherein as said convey means is moved from the second position to the first position, said image bearing member moves at a second peripheral speed slower than said first peripheral speed and the peripheral speed of said convey means as it moves from the second position to the first position is at the second peripheral speed.

2. An image forming apparatus according to claim 1, wherein said image forming apparatus starts an image forming process while said convey means is in the second position, and said convey means is moved to the first position from the second position during the image forming process.

3. An image forming apparatus according to claim 1, wherein said image bearing member and convey means start movement at different acceleration speeds.

4. An image forming apparatus according to claim 1, further comprising image forming means including charge means for electrically charging said image bearing member uniformly, exposure means for projecting a light beam corresponding to image information to said image bearing member to form a latent image thereon, and developing means for supplying the toner to said image bearing member to develop said latent image thereon.

5. An image forming apparatus according to claim 1, further comprising additional plural image bearing members wherein an image of each image bearing member is superimposedly transferred to the recording material conveyed by said convey means.

6. An image forming apparatus according to claim 1, wherein said convey means has a belt-like construction.

7. An image forming apparatus according to claim 1, wherein said convey means is positioned in the first position upon image transferring.

* * * * *

UNITED STATES PATENT AND TRADEMARK OFFICE

CERTIFICATE OF CORRECTION

PATENT NO. : 5,365,324
DATED : November 15, 1994
INVENTOR(S) : SONO GU, ET AL.

Figure 5:
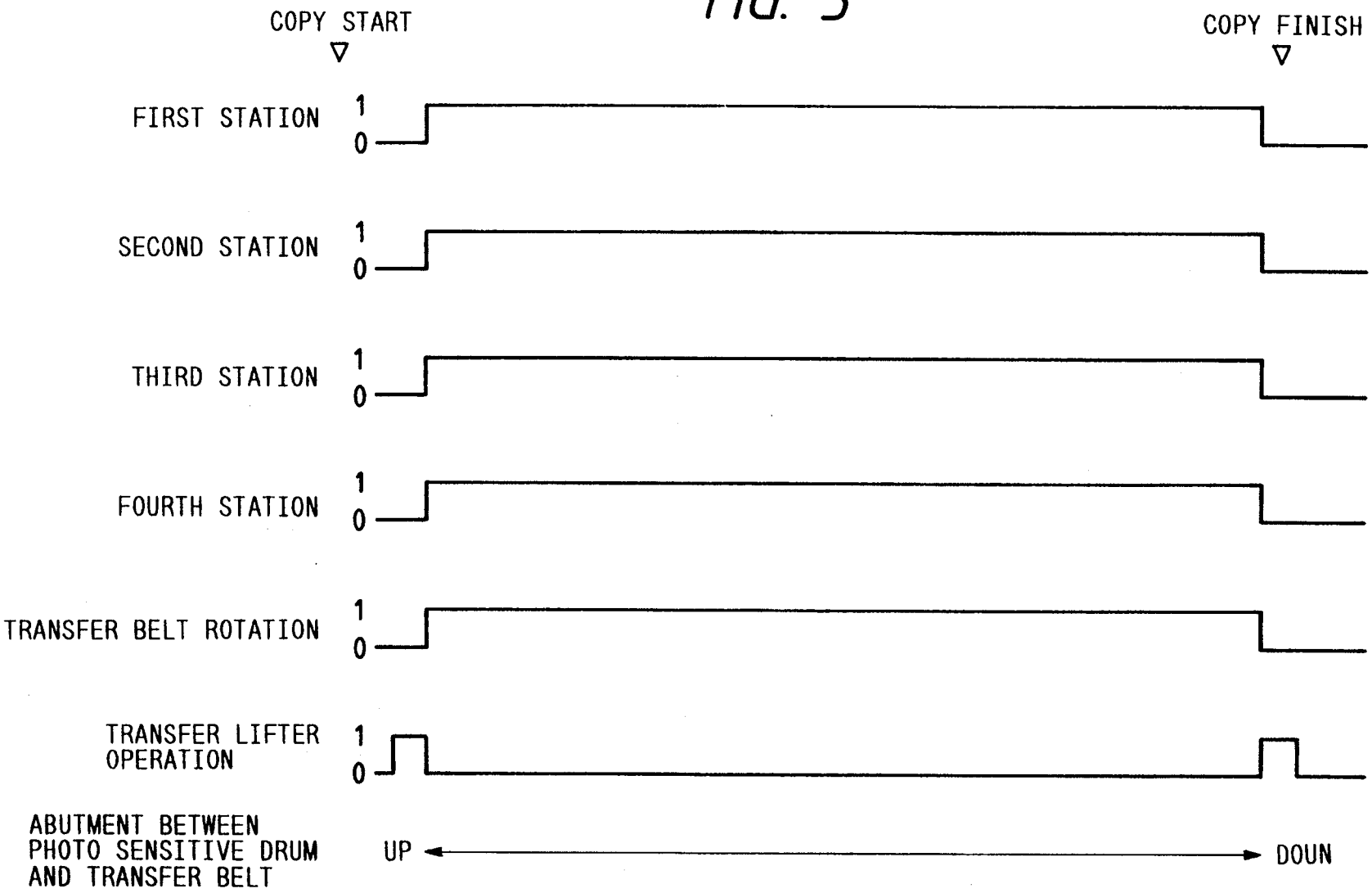
FIG. 5 is a timing chart showing an operation of the multi-image forming apparatus of FIG. 4.

It is certified that error appears in the above-indentified patent and that said Letters Patent is hereby corrected as shown below:

In the drawings, Figure 5 :
"DOUN" should read --DOWN--.

Column 2,
line 19, "arise" should read --arises--.

Column 4,
line 66, "increased" should read --be increased--; and
line 67, "drum" should read --drums--.

Column 6,
line 27, "sa" should read --as--;
line 44, "ference" should read --ferent--; and
line 65, "transfer;" should read --transfer; and--.

Signed and Sealed this

Eleventh Day of April, 1995

Bruce Lehman

*Attest:*

BRUCE LEHMAN

*Attesting Officer*

*Commissioner of Patents and Trademarks*